United States Patent [19]

Malcombe

[11] Patent Number: 4,701,764

[45] Date of Patent: Oct. 20, 1987

[54] MINIATURE HIGH-GAIN ANTENNA

[75] Inventor: Jean-Claude Malcombe, Saint-Agnant, France

[73] Assignee: Societe de Maintenance Electronique "SOMELEC", Paris, France

[21] Appl. No.: 821,787

[22] Filed: Jan. 23, 1986

[30] Foreign Application Priority Data

Jan. 28, 1985 [FR] France ..... 85 01262

[51] Int. Cl.[4] ..... H01Q 11/12

[52] U.S. Cl. ..... 343/742; 343/794; 343/908

[58] Field of Search ..... 343/742, 794, 908, 741, 343/743, 866, 867

[56] References Cited

U.S. PATENT DOCUMENTS 2,197,051 4/1940 Lindenblad ..... 343/742

4,584,586 4/1986 Kocsi ..... 343/742

*Primary Examiner*—Robert E. Wise

*Assistant Examiner*—Doris J. Johnson

*Attorney, Agent, or Firm*—Murray and Whisenhunt

[57] ABSTRACT

An antenna is adapted to be connected to a coaxial cable having a central conductor and a conductive sheath. The antenna is adapted for operation at a wavelength λ and comprises two loops disposed in substantially parallel planes the distance between which is λ/8±20%. At least one connecting element connects the loops, having a length substantially equal to the distance between them. Each loop is adapted to be connected to a respective conductor of the coaxial cable and is either closed with an approximate length of 3λ/8 or open with a length of λ/4.

8 Claims, 6 Drawing Figures

MINIATURE HIGH-GAIN ANTENNA

BACKGROUND OF THE INVENTION

1. Field of the invention

The invention concerns a high-gain antenna for radio transmission or reception in telecommunications, telemetry, radio communications or television.

2. Description of the Prior Art

In the current state of the art, high-gain antennas are usually large and often cumbersome. To achieve significant electrical gain they comprise an assembly of various elements the length of which is at least λ/4. A typical example is described in document U.S. Pat. No. 2,671,852 in which there is described an antenna comprising at least one rectangular frame the lengths of the sides of which are respectively λ/4 and λ/2.

Consider now a television antenna operating in the UMF band (YAGI antenna type); to achieve an electrical gain of the order of 15 to 20 dB, the antenna must conventionally comprise multiple elements the overall length of which is approximately 2 meters.

The main objective of the invention is to provide a radio transmission and/or reception antenna having a gain at least comparable with that of conventionally designed antennas but with significantly smaller overall dimensions.

SUMMARY OF THE INVENTION

The invention consists in an antenna adapted to be connected to a coaxial cable having a central conductor and a conductive sheath, said antenna being adapted for operation at a wavelength λ and comprising two loops disposed in substantially parallel planes the distance between which is λ/8±20% and at least one connecting element connecting said loops having a length substantially equal to the distance between them, each of said loops being adapted to be connected to a respective conductor of said coaxial cable and being either closed with an approximate length of 3λ/8 or open with a length of λ/4.

When one of the two loops is open, its two free ends are preferably each connected by a connecting element to the same point on the other loop or to an inside point connected to that loop.

The coaxial cable may terminate in the plane of one of the loops; it is preferably terminated in a median plane between the two loops and its two conductors respectively connected to the loops by two connection elements extending in opposite directions each having a length of substantially λ/16, that is to say approximately half the distance separating the two loops.

In one embodiment of the invention, the antenna is adapted to be connected to a coaxial cable having two conductors, said antenna being adapted for operation at a wavelength λ and comprising two triangles disposed in substantially parallel planes the distance between which is λ/8±20%, the distance between the corners of each triangle being substantially equal to λ/8, each triangle having one corner adapted to be connected to a respective conductor of said coaxial cable either directly or through a point inside the triangle at a distance substantially equal to λ/16 from said one corner and one of said triangles having the side opposite said one corner either present or absent, the antenna further comprising a connection established either by a connecting element from the median point of said opposite side when present to said point inside the triangle or to the corner of the other triangle adapted to be connected to one conductor of said coaxial cable, in which case said conductor of said coaxial cable is connected directly to said corner, or by two connecting elements each having a length substantially equal to λ/8 and connecting the two opposite corners of each triangle to said one corner when said opposite side is absent.

In one embodiment of the invention, when the median point of the side opposite the connection corner in a first triangle is connected to one conductor of the coaxial cable which is also connected to the connection corner of the second triangle, there is in the first triangle a connecting element between said median point of its side and its connection corner.

In another embodiment of the invention, when the connection corners of the two triangles are each connected directly to a respective conductor of the coaxial cable there exists substantially in the median plane between the planes of the two triangles a whip λ/8 long extending from the conductor of the coaxial cable connected to either of the two triangles, the connection between the triangles being then dispensed with.

In an antenna in accordance with the invention the length of the longest elements is only slightly greater than λ/8; the entire antenna is thus accommodated within a restricted volume, significantly less than that of conventional antennas. An antenna of this kind, generally of reduced volume, nevertheless has a gain that is equal to if not greater than that of a conventionally designed antenna the largest dimension of which is approximately 20 times greater than that of an antenna in accordance with the invention.

Various embodiments of the invention will now be described by way of non-limiting example only and with reference to the accompanying drawings.

DESCRIPTION OF THE PREFERRED EMBODIMENTS

Figure 1:
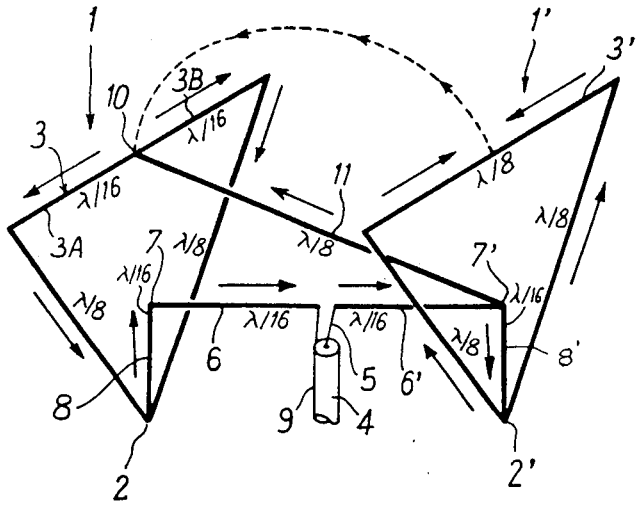
FIG. 1 is a schematic representation of an antenna in accordance with the invention having lines in opposition in closed circuit plus a reactive loop.

In the antenna shown in FIG. 1, two triangles 1 and 1' are each made up of three elements the length of each of which is λ/8. These triangles 1 and 1' are disposed in parallel planes the distance between which is substantially λ/8 with their sides parallel; they have one corner at the bottom and this will be referred to as the connection corner 2 or 2' and there therefore exists in each triangle 1 and 1' a side 3 or 3' which is opposite the connection corner 2 or 2'.

This antenna is connected to the conductors of a coaxial cable which terminates in the median plan equally spaced from the two triangles 1 and 1'. For example, the triangle 1' is connected to the central conductor 5 through the intermediary of a connection element 6' which extends from the central conductor 5 to terminate at a point 7' inside the triangle 1'. The length of this connecting element 6' is substantially equal to λ/16; the inside point 7' is at a distance equal to λ/16 from the connecting corner 2' and is connected to this corner 2' by an inside element 8' the length of which is λ/16.

The other triangle 1 is connected in like manner to the conductive sheath 9 of the coaxial cable 4 by a connecting element 6, the length of which is λ/16 and which extends in the opposite direction to the connecting element 6' to terminate in the plane of the other triangle 1 at an inside point 7; this is connected to the connection corner 2 of the same triangle 1 by an inside element 8 the length of which is equal to λ/16.

In this example, both the triangles 1 and 1' have a respective side 3 or 3' opposite the connection corner 2 or 2'; the side 3 of the first triangle 1 has a median point 10 and this point is connected by a connecting element 11 to the inside point 7' of the second triangle 1' the connecting corner 2' of which is connected as already described to the central conductor 5 of the coaxial cable 4. The length of the element 11 is substantially equal to λ/8.

The median point 10 divides the element 3 which is the base of the triangle 1 into two opposed half-elements 3A and 3B the length of each of which is λ/16.

From a functional point of view in the antenna of FIG. 1 the two elements 6 and 6' of length λ/16 extend in opposite directions from the coaxial cable and are closed by the elements 11 (λ/8), 3B (λ/16) plus one side (λ/8) constituting a first part of the triangle constituted by the elements 3A (λ/16) plus a side λ/8 of the same but opposed length, and by the inside element 8 (λ/16), so permitting distribution of the HF current on two opposed lines from the median point 10 to the connection corner 2, as indicated by the arrows. Opposed to the triangle 1 is a reactive loop consisting of the triangle 1' with three sides of length λ/8 fed by the connecting line 8'; this reactive loop reacts open line fashion with the closed line constituted by the triangle 1, as shown in dashed line in FIG. 1. The closed line: elements 6', 11, 3B, one side of the triangle, 8 and 6 or the line 6', 11, 3A, another side of the triangle, 8 and 6, corresponds to 4λ/8 and the whole to 8λ/8. The HF currents indicated by the arrows circulating in the opposed lines concentrate energy by virtue of their double action on the lines 3B plus one side of the triangle and 3A plus the other side of the triangle, as well as by virtue of the reaction of the loop.

Tuning for a minimum voltage standing wave ratio is achieved by modifying the distance separating the two triangles, that is to say the length of the elements 6, 6' and 11, to within 20% maximum.

Figure 2:
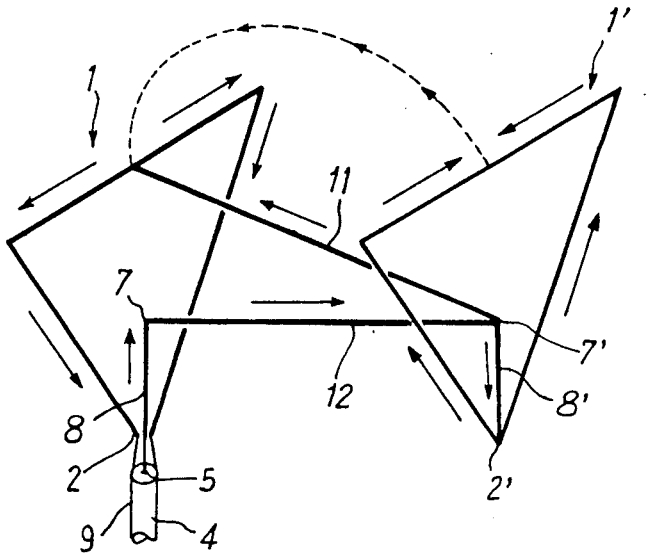
FIG. 2 shows an antenna in which a connection corner is connected directly to one conductor of a coaxial cable.

FIG. 2 shows an embodiment in which the coaxial cable 4 terminates at the connection corner 2 of the triangle 1. This corner 2 is connected directly to the conductive sheath 9 and the central conductor is connected to the inside element 8 of the triangle 1 by the end of this element which is near the corner 2 and which is isolated from the latter. The opposite end situated at the inside point 7 is connected to an element 12 of one length only (λ/8) which terminates at a point 7' inside the triangle 1'. The inside element 8' exists between the inside point 7' and the connection corner 2' of this triangle 1'.

The circulation of the HF current and the reaction of the opposed loops are also indicated by arrows and a dashed line in FIG. 2.

Figure 3:
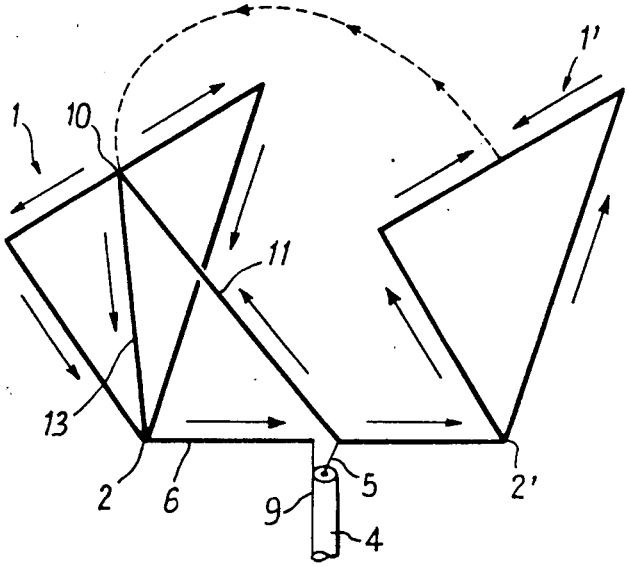
FIG. 3 shows another embodiment derived from the antenna of FIG. 1.

The embodiment shown in FIG. 3 is identical to that of FIG. 1 except that the connection elements 8 and 8' inside the triangles 1 and 1' are dispensed with. The conductors 5 and 9 of the coaxial cable 4 are therefore connected directly to the connection corners 2 and 2' of the triangles 1 and 1'. Also, the median point 10 of the base 2 of the triangle 1 is connected to the connection corner 2 of the latter by a further element 13. This element 13, together with the two sides of the triangle which terminate at the connection corner 2, conducts the HF current which reaches this corner as indicated by the arrows. In this case, tuning for a minimum voltage standing wave ratio is achieved by modifying the length of the elements 6 and 11 which extend from the coaxial cable 4 and which terminate at the second triangle 1.

Figure 4:
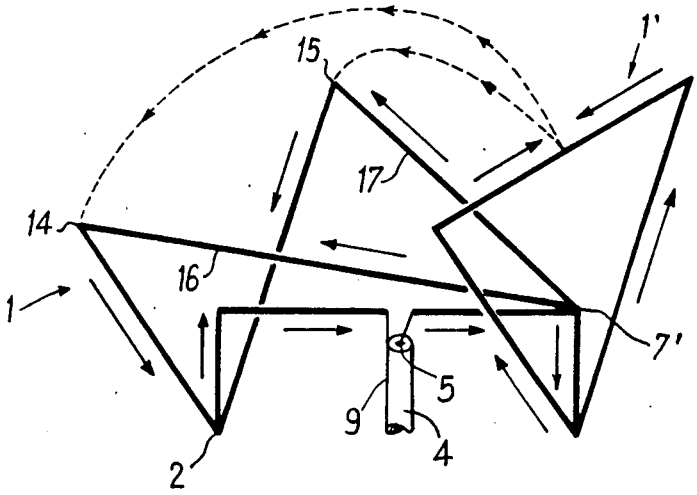
FIG. 4 shows an embodiment in which one of the triangles has the side opposite its connection corner missing.

FIG. 4 shows an antenna embodiment identical to that of FIG. 1 except that the second triangle 1 has no side opposite the connection corner 2. In this case the two corners 14 and 15 opposite the corner 2 are connected by respective connecting elements 16 and 17 to the point 7' inside the first triangle 1', in substitution for the non-existent element 11. As indicated by the arrows, the HF current flows towards the triangle 1 along these two elements 16 and 17.

In this embodiment, the first triangle 1 constitutes an open loop consisting only of the two sides between the corners 2 and 14 on the one hand and 2 and 15 on the other hand; the length of each of these sides is λ/8, whereby their total length is λ/4. Note that like the element 17, the length of the element 16 is substantially λ/8. This embodiment is equivalent to detaching the side 3 from one corner and pivoting it relative to the other corner of the triangle 1 so as to fix it to the point 7' inside the triangle 1'. Simultaneously, the connecting element (11 in FIG. 1), no longer having the median point 10 to attach to, is connected to the corner 15.

Figure 5:
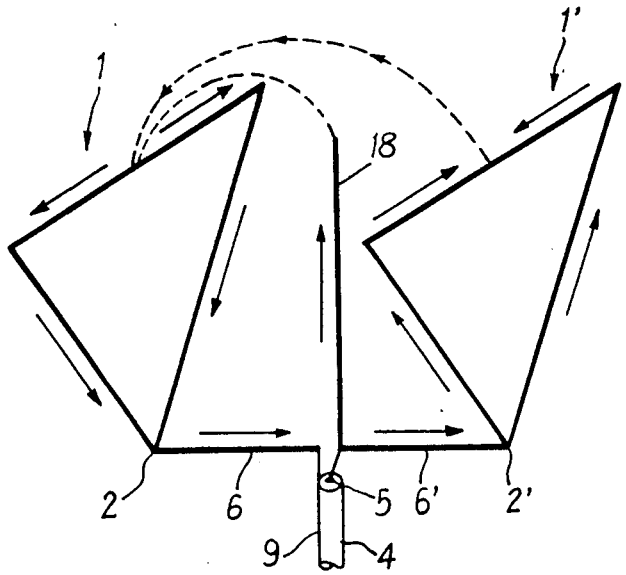
FIG. 5 shows another embodiment in which reactive loops are in opposition on open lines.

In the examples described above there is a material connection between the two triangles 1 and 1', provided by the elements 11 or 16 and 17. Instead of this "closed" structure there may be adopted an open structure like that shown in FIG. 5. In this, the connection corners 2 and 2' of the two triangles 1 and 1' are each directly connected to one conductor of the coaxial cable 4, as in the example of FIG. 3. The connecting elements 11 or 16 and 17 between the triangles are dispensed with and there is provided, substantially in the median plan between the two triangles 1 and 1', a reactive whip 18 which is λ/8 long. This whip 18 is situated between the triangles 1 and 1'. In this antenna two elements 6 and 6' the length of each of which is λ/16 and which are disposed in opposition each feed one triangular loop made up of three elements each λ/8 long; the current flow is also shown by arrows in FIG. 5.

Note that in all cases the construction of the antenna in two loops connected in opposition by elements of length λ/16 each confers on the antenna an overall length of λ/8.

This method of construction using opposed lines within a volume having a linear dimension of λ/8 makes it possible to implement miniature antennas for transmission or reception in all systems of telecommunication, telemetry, radio communications or television, fixed or mobile, in a very wide frequency band with no limitation other than the feasibility of manufacture within a minimum or maximum overall size.

For example, for a frequency of 145 MHz, that is a wavelength of 2 meters, a conventional YAGI antenna comprises nine elements making it 2 meters long, whereas an antenna in accordance with the invention has a length of 0.25 meters, reducing the overall size by 1.75 meters. An antenna in accordance with the invention as shown in FIGS. 1 through 5 for the television band with a center frequency of 503.25 MHz has an overall length of 75 millimeters. The voltage standing wave ratio (VSWR) is minimal (1.1/1).

An antenna in accordance with the invention can be manufactured in magnetic or amagnetic material, solid or tubular with the cross-section related to the bandwidth, in steel, copper, aluminum or various alloys, for example.

In the foregoing examples reference is made, for convenience, to implementations in which the loops disposed at the ends of two opposed lines are triangles. This geometrical shape is not a pre-requisite of the invention; modifications departing from the triangular configuration as described are possible without departing from the scope of the invention.

Figure 6:
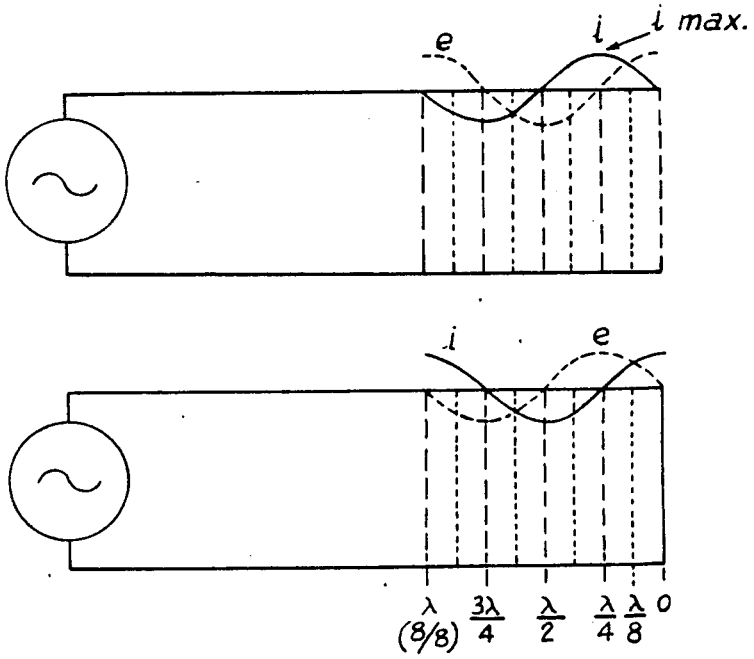
FIG. 6 comprises two graphs used to explain the circulation of the HF current in an open or closed path in antennas in accordance with the invention.

FIG. 6 shows the distribution of peaks and troughs in the voltage (dashed line) and current (full line) in an antenna in accordance with the invention, form a point 0 which is, for example, the point at which the connecting element 6' is connected to the central conductor 5 of the coaxial cable 4. The top diagram relates to the open structure antenna of FIG. 5; the bottom diagram refers to the closed structure antennas of FIGS. 1 through 4.

With two loops disposed in opposition, and of triangular shape, for example (although any other shape may suit, as explained above), with each side measuring approximately one-eighth of the wavelength and spaced by one-eighth of the wavelength to within the tolerance indicated hereinabove, fed from one corner (case of triangular loops), the HF current circulates in the two branches to rejoin at a common point by virtue of the fact that the elements are dimensioned and arranged in such a way that the currents do not oppose each other.

The current thus formed into a loop continues to flow towards the other loop, in an open line, to terminate at the parallel feed point.

It is also possible to provide other elements in which the current may arise, so permitting maximum HF current to be concentrated at the feed point.

As the gain of the antenna is dependent on the concentration of the HF current, it will be at least equal to that of a conventional antenna but obtained with one twentieth the overall size.

As has already been stated, the invention gives rise to a very large number of antennas, of various geometries, within a volume having a linear dimension of the order of $\lambda/8$ and to which director or reflector elements may be added to enhance the gain or directivity. It is also possible to couple together a plurality of such antennas, with the overall size remaining significantly less than that of conventional antennas.

There is claimed:

1. A high-gain antenna adapted for transmission and reception and adapted to be connected to a coaxial cable having a central conductor and a conductive sheath, said antenna being adapted for operation at a wavelength $\lambda$ and comprising two loops disposed in substantially parallel planes the distance between which is $\lambda/8\pm20\%$ and at least one connecting element connecting said loops having a length substantially equal to the distance between them, each of said loops being adapted to be connected to a respective conductor of said coaxial cable and said loops being selected from a closed loop with an approximate length of $3\lambda/8$ and or open loop with a length of $\lambda/4$.

2. Antenna according to claim 1, adapted to have a coaxial cable terminate substantially in the plane of one of said loops and further comprising a connecting element having a length substantially equal to $\lambda/8$ extending between one conductor of said coaxial cable and the other of said loops.

3. Antenna according to claim 1, adapted to have a coaxial cable terminate substantially in a median plane between said loops and further comprising two connecting elements extending in respective opposite directions from said median plan, each having a length substantially equal to $\lambda/16$ and each adapted to connect one conductor of said coaxial cable to a point on a respective loop.

4. Antenna according to claim 3, further comprising a reactive whip having a length of $\lambda/8$ disposed substantially in said median plane and adapted to be connected to one conductor of said coaxial cable.

5. Antenna according to claim 4, wherein each of said loops comprises a triangle having three sides each of which has a length substantially equal to $\lambda/8$ and one corner adapted to be connected to one conductor of said coaxial cable.

6. Antenna according to claim 1, wherein each loop is triangular and comprises either three sides defining a closed loop or two sides defining an open loop, the point common to said two sides being adapted to be connected to one conductor of said coaxial cable.

7. Antenna adapted to be connected to a coaxial cable having two conductors, said antenna being adapted for operation at a wavelength $\lambda$ and comprising two triangles disposed in substantially parallel planes the distance between which is $\lambda/8\pm20\%$, the distance between the corners of each triangle being substantially equal to $\lambda/8$, each triangle having one corner adapted to be connected to a respective conductor of said coaxial cable at a distance substantially equal to $\lambda/16$ from said corners the antenna further comprising a connection established by a connecting element from a median point of a side of a triangle.

8. Antenna according to claim 7, wherein said one triangle has said opposite side present and said median point of said opposite side is connected by a first connecting element to the other triangle and by a second connecting element to said one corner of said one triangle.

* * * * *